US007368675B2

(12) United States Patent
Ishido et al.

(10) Patent No.: US 7,368,675 B2
(45) Date of Patent: May 6, 2008

(54) EXTERNAL OPERATION HANDLE DEVICE FOR A CIRCUIT BREAKER

(75) Inventors: Hideki Ishido, Otawara (JP); Makoto Osawa, Otawara (JP); Takeshi Emura, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 11/802,639

(22) Filed: May 24, 2007

(65) Prior Publication Data

US 2007/0272526 A1 Nov. 29, 2007

(30) Foreign Application Priority Data

May 29, 2006 (JP) ..... 2006-147718

(51) Int. Cl.
*H01H 3/00* (2006.01)

(52) U.S. Cl. ..... 200/331; 200/400; 200/330

(58) Field of Classification Search ..... 200/17 R, 200/330, 331, 334, 400, 401, 500, 501, 43.11, 200/43.14, 43.15
See application file for complete search history.

(56) References Cited

U.S. PATENT DOCUMENTS 5,302,925 A * 4/1994 Castonguay et al. ..... 335/17
5,902,973 A * 5/1999 Ramey et al. ..... 200/50.01
6,124,558 A * 9/2000 Baumeister et al. ..... 200/501
6,441,329 B2 * 8/2002 Guille et al. ..... 200/400
6,518,526 B2 * 2/2003 Hamada et al. ..... 200/330
6,566,618 B2 * 5/2003 Hamada et al. ..... 200/308
6,576,851 B1 * 6/2003 Barlian et al. ..... 200/5 R
6,969,813 B1 * 11/2005 Winslett et al. ..... 200/330
7,002,088 B2 * 2/2006 Shin ..... 200/330
7,214,895 B2 * 5/2007 Houck et al. ..... 200/310

FOREIGN PATENT DOCUMENTS

JP 2005-149918 6/2005

* cited by examiner

*Primary Examiner*—Michael A Friedhofer
(74) *Attorney, Agent, or Firm*—Manabu Kanesaka

(57) ABSTRACT

An external operation handle device is used for a circuit breaker for switching a locker handle to ON and OFF positions. The handle device includes a main body casing for the circuit breaker, a mount base held on the main body casing, a rotary handle grip mounted on the mount base for turning the locker handle to the ON and OFF positions and having a connecting shaft, and an assist mechanism for moving the handle grip to a TRIP indication position upon tripping operation of the circuit breaker. The assist mechanism is interposed between the mount base and the handle grip, and includes a cam with a cam face, fixed on the mount base, a cam follower linking with the handle grip slidably along an axial direction and opposing the cam face of the cam, and an urging spring for pushing the cam follower against the cam face.

6 Claims, 5 Drawing Sheets

Fig. 5 Prior Art
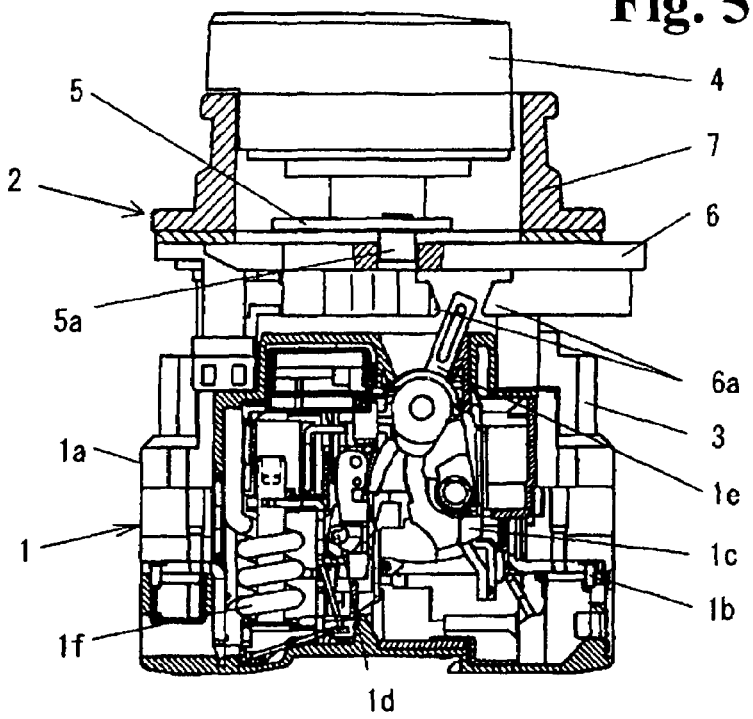
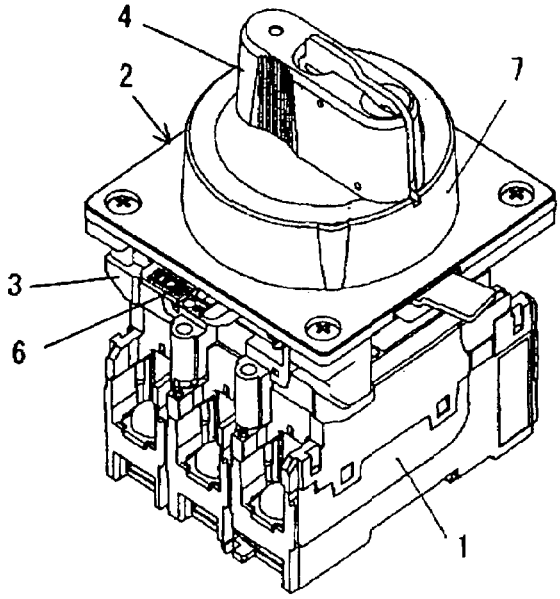
Fig. 6 Prior Art

EXTERNAL OPERATION HANDLE DEVICE FOR A CIRCUIT BREAKER

BACKGROUND OF THE INVENTION AND RELATED ART STATEMENT

The present invention relates to an external operation handle device for circuit breakers, for example, molded case circuit breaker, earth leakage breaker, and the like.

An external operation handle device is used as an accessory device with a molded case circuit breaker, earth leakage breaker, etc. for conducting switching operation on a circuit breaker attached to a distribution board or a control board from outside the board.

An external operation handle device comprises a rotary handle grip and a slide base linked to the handle grip through a turn base, mounted on a mount base. In the state with the handle device mounted on a circuit breaker, the slide base is engaged with a locker handle of the circuit breaker and the handle grip is turned to drive the locker handle of the circuit breaker to ON and OFF positions through the turn base and the slide base.

Concerning an external operation handle device, Patent Document 1 discloses means, which enables to avoid a problem that a handle grip stops before reaching a TRIP indication position during movement from ON position towards the TRIP indication position in trip operation of the circuit breaker due to frictional drag against sliding of a movable mechanism of the handle device, and to assist correct indication of trip operation of the circuit breaker. Patent Document 1 discloses an assist mechanism comprising levers with rollers provided at both sides of a cam formed on the slide base, and a pressure is exerted by an urging spring through the rollers from a direction perpendicular to the moving direction of the slide base. The spring force acting on the tapered cam face forces the handle grip linked with the slide base to the TRIP indication position. The assisting mechanism is shown in FIGS. 5 through 8.

In those figures, reference numeral 1 designates a circuit breaker and numeral 2 designates an external operation handle device mounted on the circuit breaker 1. The circuit breaker 1 comprises a main casing 1*a*; a fixed contact 1*b*; a movable contact 1*c*; a switching mechanism 1*d* of a toggle linkage type; a locker handle 1*e* linking with the switching mechanism 1*d* and disposed at the top of the casing 1*a*; and an overcurrent tripping device 1*f*, all of which are installed in the main casing 1*a*.

Switching operation of such a circuit breaker 1 is well known. When the locker handle 1*e* is turned from the ON position shown in FIG. 5 to the OFF position at the left side, the toggle link of the switching mechanism 1*d* is reversed and the movable contact 1*c* is opened receiving an urging force of the toggle spring. When an overcurrent is developed in the main circuit and then the overcurrent tripping device functions, the switching mechanism 1*d* trips and the movable contact 1*c* opens to automatically interrupt the current in association with the trip. In this trip operation, the locker handle 1*e* moves from the ON position to an intermediate position (trip indication position) between the ON position and the OFF position following the movement of the toggle linkage of the switching mechanism 1*d* and stops at this position.

The external operation handle device 2 comprises, as disclosed in detail in Patent Document 1, a mount base 3; a handle grip 4 of a rotary type; a turn base 5; a slide base 6; and a handle cover 7, that are mounted on the mount base 3.

The locker handle 1*e* is engaged with the slide base 6 in conjunction with the handle device mounted on the circuit breaker 1 (FIG. 5).

The turn base 5 is connected to a shaft of the handle grip 4. The slide base 6 is located in the back surface side of the mount base 3. The slide base 6 is guided and supported so as to slide in the direction of opening and closing of the locker handle 1*e*. The slide base 6 is provided with an oblong hole opened in the central region of the slide base along the direction perpendicular to the sliding direction. A pin (crank pin) 5*a* provided on the turn base 5 is engaged with the oblong hole and links with the handle grip 4. At the back surface side of the slide base 6, handle arms 6*a* are projecting at either side of the locker handle 1*e* of the circuit breaker 1. A name plate 7*a* is affixed on the periphery of the top surface of the handle cover 7 and indicates positions of ON, TRIP, OFF and RESET of the handle grip 4.

When the handle grip 4 is manipulated to turn from the ON position to the OFF position, the slide base slides leftward from the position in FIG. 5 through the pin 5*a* of the turn base 5 shifting the locker handle 1*e* of the circuit breaker 1 to the OFF position through the handle arms 6*a*.

The slide base 6 is provided with an assisting mechanism, as disclosed in Patent Document 1, comprising a cam and a pressing lever that makes the rollers contact with tapered cam faces at left and right sides of the cam and exerts a spring force pushing against the tapered cam faces. As shown in detail in FIG. 8, a cam 6*b* is formed on the back surface of the slide base 6, and a pair of levers 8*b* pivotally supported with a screw 8*a* at one end thereof is provided at both sides of the cam 6*b* in left and right side region of the mount base 3. The rollers (bearings) 8*c* provided on the levers 8*b* push the cam face 6*b*-1 by the spring force of urging springs 8*d*.

When the circuit breaker 1 trips, the slide base 6 pushed by the locker handle 1*e* starts to move leftward from the position (ON position) in FIG. 8. In a middle of the movement, the rollers 8*c* in contact with the cam 6*b* comes to the tapered portion of the cam face, where the slide base 6 receives a leftward driving force by the spring force of the urging spring 8*d*. Thus, the handle grip 4 of the external operation handle device 2 moves from the ON position to the TRIP position shown in FIG. 7 indicating trip operation of the circuit breaker.

Patent Document 1: Japanese Unexamined Patent Application Publication No. 2005-149918

The conventional assisting mechanism provided in an external operation handle device, however, involves problems of high production costs due to a large number of parts including pairs of levers 8, rollers 8*c*, and urging springs 8*d*, and large number of steps for their assembly. Furthermore, the size of the external operation handle device has to be large enough to ensure a space occupied by these parts in the mount base 3.

The invention provides an external operation handle device for a circuit breaker having an assist mechanism with improved structure to reduce the number of parts and steps for assembling, and down-sized and compact structure of the device.

Further objects and advantages of the invention will be apparent from the following description of the invention.

SUMMARY OF THE INVENTION

To achieve the above object, in the first aspect of the invention, an external operation handle device, according to the present invention, has an assembly structure mounting a handle grip, a turn base connected to the handle grip through a connecting shaft, and a slide base linked to the turn base on a mount base for fixedly holding to a main body casing of the circuit breaker. The external operation handle device further comprises an assist mechanism for moving the handle grip to a TRIP indication position upon tripping operation of the circuit breaker. The assisting mechanism is interposed between the mount base and the handle grip, and includes a cam fixed on the mount base, a cam follower linking with the handle grip so as to slide along an axial direction and opposing a cam face of the cam, and an urging spring for pushing the cam follower against the cam face.

Specifically, in the second aspect of the invention, the assisting mechanism has the following modes of structures. The cam is a cylindrical end face cam having cam faces of peaks and valleys formed in axial symmetry at an end face of the cam, and the cam follower has a protruding contact which transversely crosses by the end face of the cam.

In the third aspect, also, the assisting mechanism is disposed concentrically in a hollow shaft connecting the handle grip and the turn base.

In a closed state of the circuit breaker with the above-described structure of the external operation handle device, the cam follower of the assisting mechanism is in contact with the peaks of the cam face of the cam and is pushed by the urging spring at this position. When the circuit breaker trips and the handle grip starts to rotate from the ON position towards the TRIP indication position following the movement of the locker handle, the contact of the cam follower connected to the handle grip acceleratedly slips down along the slanted face of the end face of the cam from the peaks towards valleys receiving a spring force of the urging spring, and at the same time, gives a rotating force on the cam follower by the spring force.

As a result, the handle grip is forced to move from the ON position to the TRIP indication position overcoming the frictional force acting against sliding of the movable parts (turn base, slide base and others) of the external operation handle device. Therefore, correct indication of the trip operation of the circuit breaker is ensured.

Furthermore, the assisting mechanism comprises the cam, the cam follower, and the urging spring disposed concentrically in the hollow connecting shaft that connects the handle grip and the turn base; and is covered by the handle cover around the assist mechanism. Therefore, the external operation handle device is smaller than the conventional one with the structure as shown in FIG. 8.

BRIEF DESCRIPTION OF THE DRAWINGS

FIG. 5 is a side sectional view of an external operation handle device of a prior art in combination with a circuit breaker;

FIG. 6 is a perspective view of FIG. 5;

DETAILED DESCRIPTION OF THE INVENTION

Figure 1:
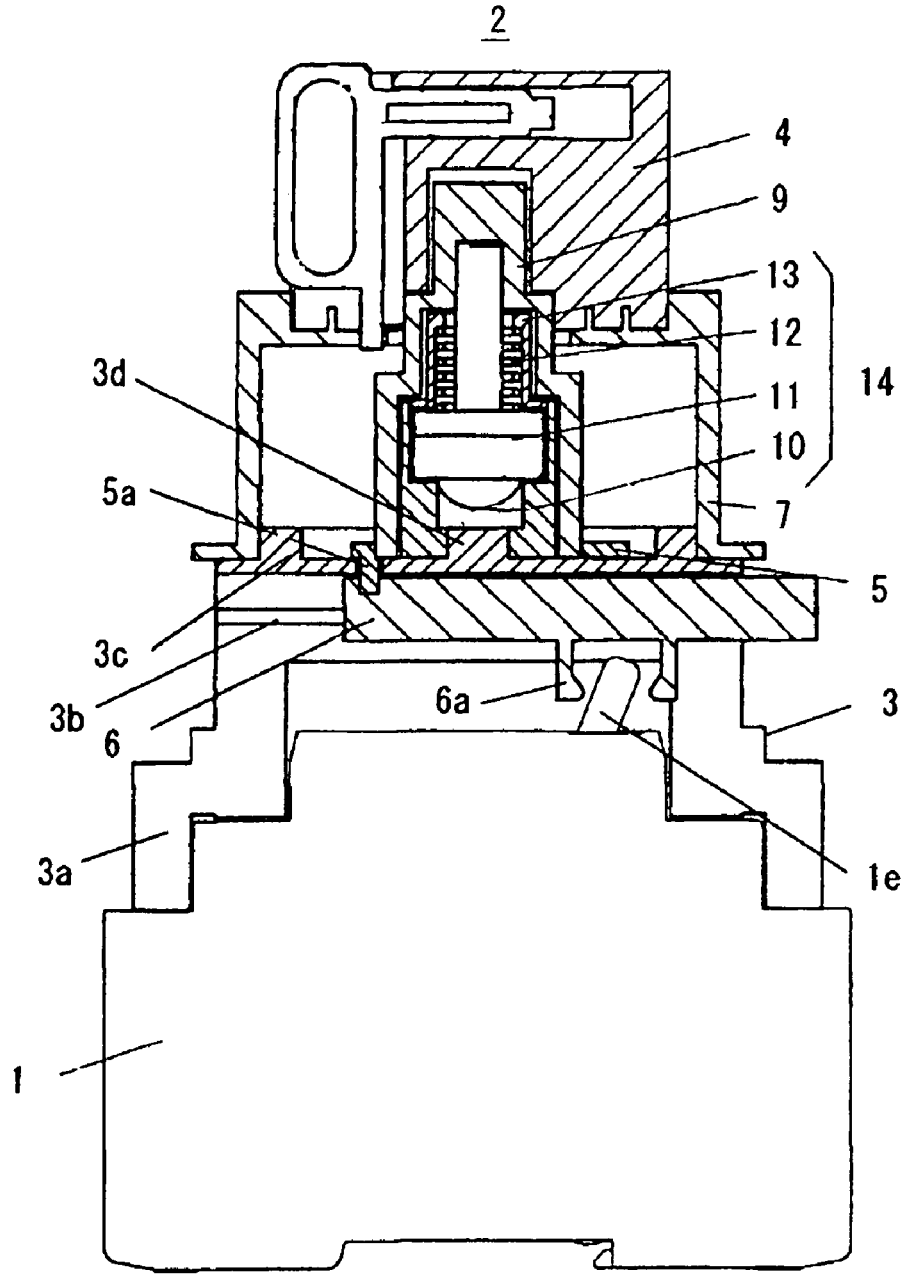
FIG. 1 is a vertical sectional view of an external operation handle device of an embodiment according to the preset invention, the handle device being mounted on a circuit breaker.

An embodiment, according to the present invention, will be described in the following with reference to FIGS. 1 through 4. In the Figures, parts corresponding to the parts shown in FIGS. 5 through 8 are designated by the same reference numerals, and their description is omitted.

In the external operation handle device 2 of the embodiment shown in the Figures, a handle grip 4 and a turn base 5 are connected by a connecting shaft 9 with a hollow structure. In the hollow connecting shaft 9 between the handle grip 4 and the turn base 5, an assisting mechanism 14 is provided, which comprises a cam 10, a cam follower 11*a*, an urging spring 12, and a spring cover 13.

Figure 2:
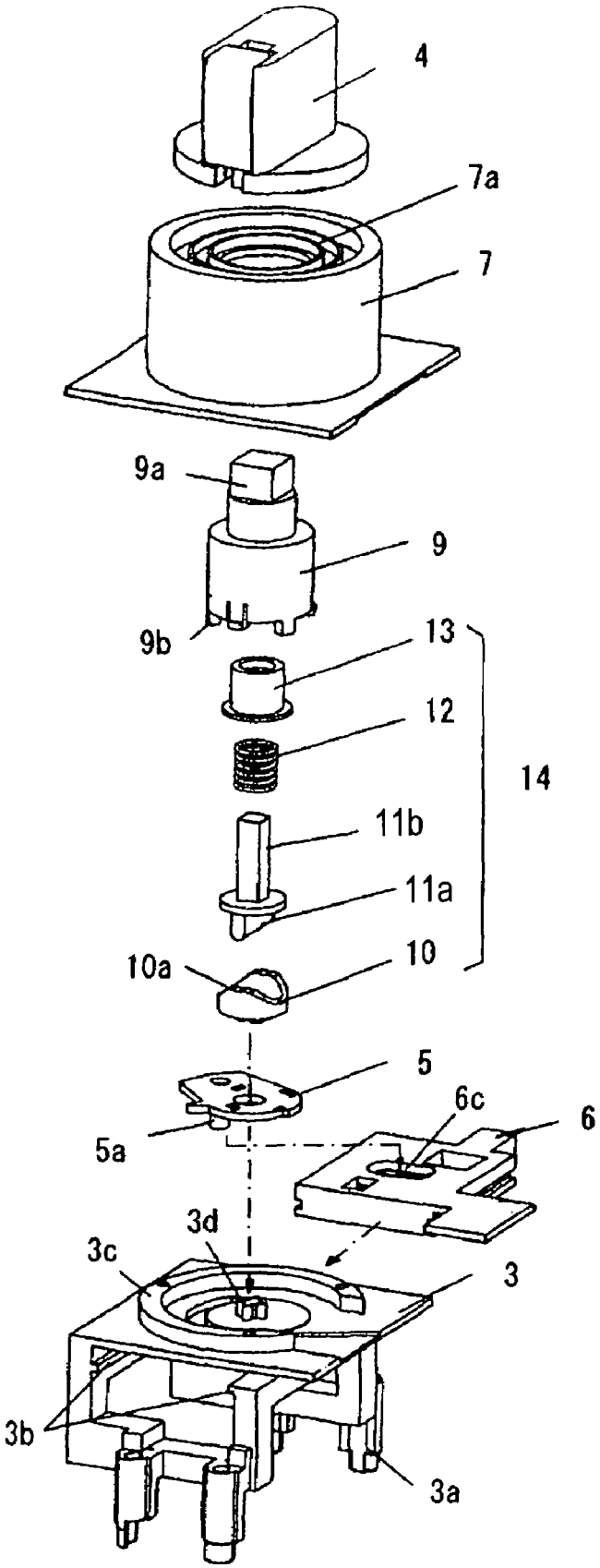
FIG. 2 is an exploded perspective view of the external operation handle device in FIG. 1.

As shown in the disassembled drawing of FIG. 2, a square rod portion 9*a* at the top of the hollow connecting shaft 9 is press-fitted into a hole opened on the bottom surface of the handle grip 4, and the engaging protrusions 9*b* formed around the periphery of the bottom of the connecting shaft are fitted to engage holes opened on the plate face of the turn base 5, thereby connecting the handle grip 4 and the turn base 5.

The cam 10 of the assisting mechanism 14 is a cylindrical end face cam with a cam face 10*a* having peaks and valleys extending in an axial symmetry and formed on the end face of the cam. The cam 10 is engaged with a cross-shaped protrusion 3*d* provided on the center of the upper surface of the mount base 3 and fixed at this position. The cam follower 11*a*, disposed above and opposing the cam 10, is assembled with an urging spring (a compression spring) 12 and a cover 13 that are inserted to a square stud 11*b*, and fitted to a square pit formed at the top portion of the hollow connection shaft 9 in a fit drive connection manner. The cam follower 11*a* has, at the lower end thereof, a contact 11*a* with a protruding wall shape such that it radially crosses by the cam face 10*a* of the cam 10.

In the mount base 3 in FIG. 2, the reference numeral 3*a* designates legs for fixing on a main body casing 1*a* of the circuit breaker 1 (FIG. 5), the numeral 3*b* designates rails for sliding to guide and support the slide base 6, and the numeral 3*c* designates a guide for engaging and supporting the handle cover 7. A ring-shaped guide rail 7*a* is formed on the handle cover 7 for rotating to guide and support the handle grip 4.

Figure 3:
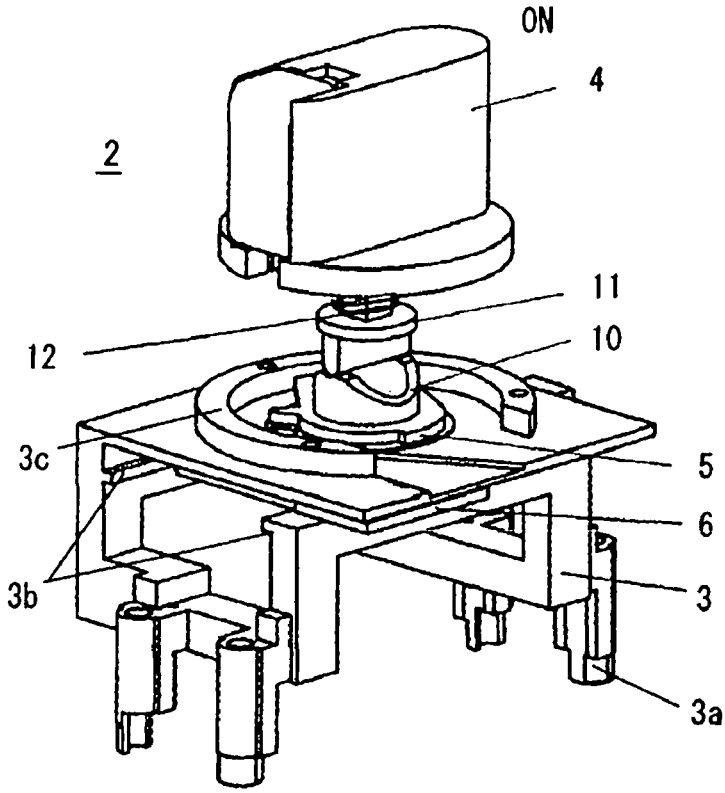
FIG. 3 illustrates an operational status of the external operation handle device corresponding to ON position in FIG. 1.
Figure 4:
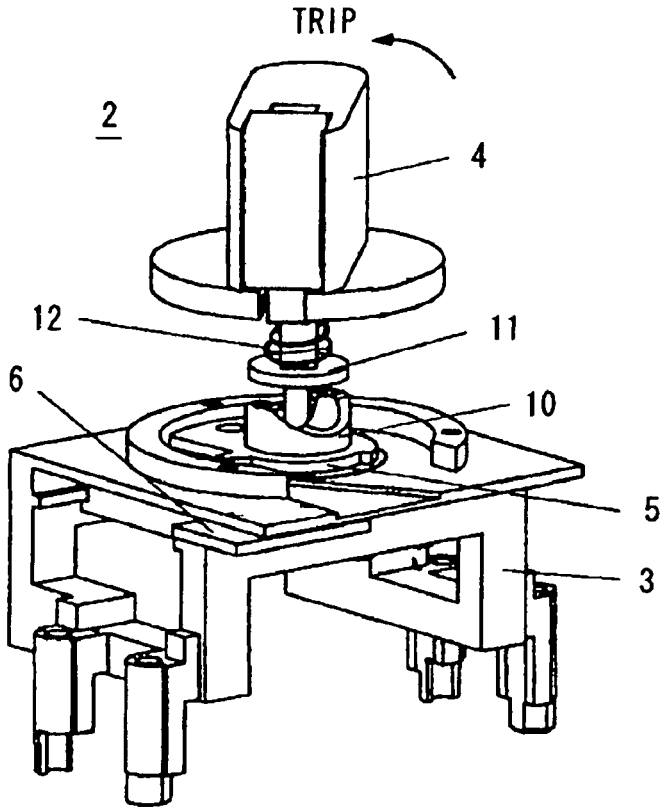
FIG. 4 illustrates an operational status of the external operation handle device in a trip operation of the circuit breaker.
Figure 7:
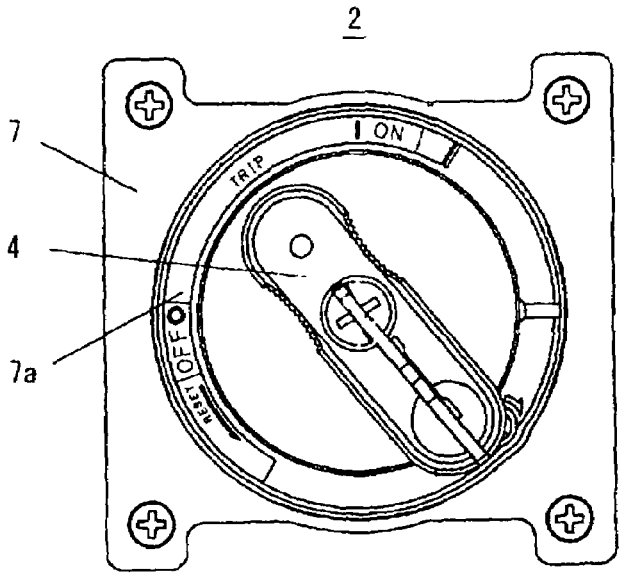
Fig. 7 Prior Art
FIG. 7 is a plan view of the external operation handle device in FIG. 5.

The operation of the assisting mechanism, having the above-described structure, is described in the following. In the closed state of the circuit breaker in which the handle grip 4 of the external operation handle device 2 has been moved to the ON position, the contact of the cam follower 11*a* connected to the handle grip 4 sits on the peaks of the cam face formed at the end face of the cam 10, and stops to be held at this position as shown in FIG. 3. When the circuit breaker trips and the handle grip 4 of the external operation handle device 2 starts to rotate towards the TRIP indication position following the movement of the locker handle 1*e* of the circuit breaker 1 as described previously referring to FIG. 5, the contact of the cam follower 11*a* connected to the handle grip 4 acceleratedly slips down along the slanted face from peaks towards valleys of the cam face formed on the end face of the cam 10 receiving a spring force from the urging spring 12, and at the same time, the spring force of the urging spring 12 gives a torque in the counterclockwise to the cam follower 11*a*.

As a result, the handle grip 4 is acceleratedly moved from the ON position to the TRIP indication position overcoming the frictional force acting against sliding of the movable parts (turn base 5, slide base 6 and others) of the external operation handle device 2. Therefore, correct indication of trip operation of the circuit breaker is ensured.

Figure 8:
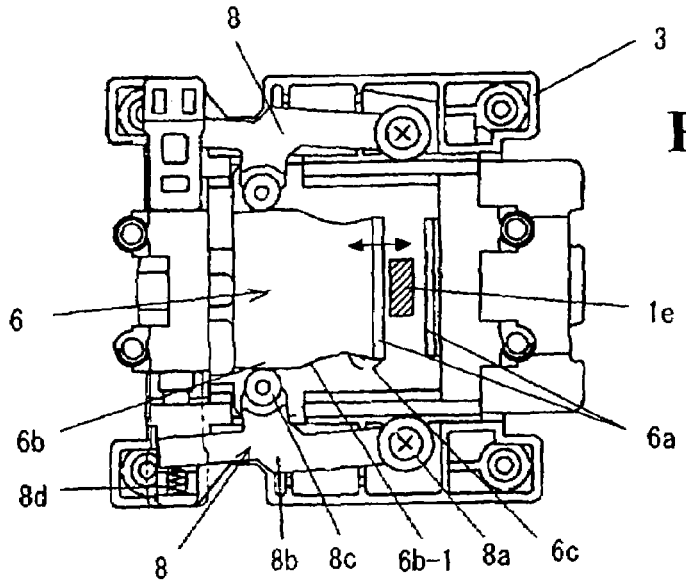
Fig. 8 Prior Art
FIG. 8 is a view from a back surface around a slide base illustrating an assist structure provided in the external operation handle device of FIG. 5.

Furthermore, the assisting mechanism 14 comprises the cam 10, the cam follower 11*a*, the square stud 11*b*, the urging spring 12, and the spring cover 13. The assisting mechanism 14 is disposed concentrically in the hollow connecting shaft 9 that connects the handle grip 4 and the turn base 5, and covered by the handle cover 7 around the assist mechanism. Therefore, the external operation handle device 2 is smaller than the conventional one with the structure as shown in FIG. 8.

The disclosure of Japanese Patent Application No. 2006-147718 filed on May 29, 2006 is incorporated as a reference.

While the invention has been explained with reference to the specific embodiments of the invention, the explanation is illustrative and the invention is limited only by the appended claims.

What is claimed is:

1. An external operation handle device for a circuit breaker with a locker handle for switching the locker handle to ON and OFF positions, comprising:

a main body casing for the circuit breaker, a mount base held on the main body casing, a rotary handle grip mounted on the mount base for turning the locker handle to the ON and OFF positions and having a connecting shaft, and an assist mechanism for moving the handle grip to a TRIP indication position upon tripping operation of the circuit breaker, the assist mechanism being interposed between the mount base and the handle grip, and including a cam with a cam face, fixed on the mount base, a cam follower linking with the handle grip slidably along an axial direction and opposing the cam face of the cam, and an urging spring for pushing the cam follower against the cam face.

2. An external operation handle device according to claim 1, wherein the cam has a cylindrical shape having cam faces of peaks and valleys formed symmetrically at an end face of the cam, and the cam follower has a protruding contact transversely crossing the end face of the cam.

3. An external operation handle device according to claim 2, wherein the cam follower is disposed inside the connecting shaft, and the urging spring is a coil spring disposed around the cam follower.

4. An external operation handle device according to claim 1, wherein the assist mechanism is disposed concentrically in a hollow shaft connecting the handle grip and a turn base.

5. An external operation handle device according to claim 1, further comprising a turn base connected to the handle grip through the connecting shaft, and a slide base linked to the turn base and slidably guided and supported by rails provided on the mount base.

6. An external operation handle device according to claim 1, further comprising a distribution board or a control board to which the external operation handle device is attached.

* * * * *